US011453037B2

(12) United States Patent
Saika et al.

(10) Patent No.: US 11,453,037 B2
(45) Date of Patent: Sep. 27, 2022

(54) FORMING SYSTEM

(71) Applicant: SUMITOMO HEAVY INDUSTRIES, LTD., Tokyo (JP)

(72) Inventors: Masayuki Saika, Ehime (JP); Masayuki Ishizuka, Ehime (JP); Kimihiro Nogiwa, Ehime (JP); Akihiro Ide, Ehime (JP); Norieda Ueno, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 423 days.

(21) Appl. No.: 16/512,492

(22) Filed: Jul. 16, 2019

(65) Prior Publication Data

US 2019/0337034 A1 Nov. 7, 2019

Related U.S. Application Data

(63) Continuation of application No. PCT/JP2018/012991, filed on Mar. 28, 2018.

(30) Foreign Application Priority Data

Mar. 30, 2017 (JP) ..... JP2017-068336

(51) Int. Cl.
*B21C 37/06* (2006.01)
*B21D 26/033* (2011.01)
*H05B 3/03* (2006.01)

(52) U.S. Cl.
CPC ..... *B21C 37/06* (2013.01); *B21D 26/033* (2013.01); *H05B 3/03* (2013.01)

(58) Field of Classification Search
CPC ..... B21D 37/16; B21D 37/147; B21D 37/06; H05B 3/03

(Continued)

(56) References Cited

U.S. PATENT DOCUMENTS 4,712,295 A * 12/1987 Peele ..... B21D 53/88 269/126
10,173,254 B2 1/2019 Ueno et al.
(Continued)

FOREIGN PATENT DOCUMENTS

CN 204470409 U 7/2015
JP H10-299980 A 11/1998
(Continued)

OTHER PUBLICATIONS

Search Report issued in European Application No. 18774339.8, dated Apr. 3, 2020.

*Primary Examiner* — Thien S Tran
(74) *Attorney, Agent, or Firm* — Michael Best & Friedrich LLP

(57) ABSTRACT

A forming system forming a metal pipe by expanding a metal pipe material, includes: a main body part having a forming die for forming the metal pipe; an electrode causing a current to flow through the metal pipe material disposed in the forming die such that the metal pipe material is heated; a power supply unit disposed at a position separated from the main body part and supplying power to the electrode; and a power supply line connecting the power supply unit and the electrode, in which the power supply line includes a lower-side passing portion passing through a lower side of a placing surface on which the main body part is placed, a first connection portion drawn to an upper side of the placing surface and connecting the lower-side passing portion and the electrode, and a second connection portion connecting the lower-side passing portion and the power supply unit.

3 Claims, 9 Drawing Sheets

(58) Field of Classification Search
USPC ..... 219/83, 201
See application file for complete search history.

(56) References Cited

U.S. PATENT DOCUMENTS

| | | | | |
|---|---|---|---|---|
| 2007/0101786 | A1* | 5/2007 | Yang | B21D 26/033 72/61 |
| 2017/0095854 | A1* | 4/2017 | Ishizuka | B21D 26/047 |

FOREIGN PATENT DOCUMENTS

| | | | |
|---|---|---|---|
| JP | 2001-252788 | A | 9/2001 |
| JP | 2002-096118 | A | 4/2002 |
| JP | 2015-112608 | A | 6/2015 |
| WO | WO-2015-194660 | A1 | 12/2015 |

* cited by examiner

FORMING SYSTEM

RELATED APPLICATIONS

The contents of Japanese Patent Application No. 2017-068336, filed Mar. 30, 2017, and of International Patent Application No. PCT/JP2018/012991, filed Mar. 28, 2018, on the basis of each of which priority benefits are claimed in an accompanying application data sheet, are in their entirety incorporated herein by reference.

BACKGROUND

Technical Field

Certain embodiments of the present invention relate to a forming system.

Description of Related Art

In the related art, a forming apparatus in which a metal pipe is closed by a forming die and blow-formed is known. For example, a forming apparatus of the related art includes a forming die, and a gas supply unit which supplies gas into a metal pipe material. In this forming apparatus, the metal pipe material is formed into a shape corresponding to the shape of the forming die by disposing the metal pipe material in the forming die and expanding the metal pipe material by supplying gas from the gas supply unit to the metal pipe material in a state where the forming die is closed.

SUMMARY

According to an embodiment of the present invention, there is provided a forming system which forms a metal pipe by expanding a metal pipe material, including: a main body part having a forming die for forming the metal pipe; an electrode causing an electric current to flow through the metal pipe material disposed in the forming die such that the metal pipe material is heated; a power supply unit which is disposed at a position separated from the main body part and supplies electric power to the electrode; and a power supply line which connects the power supply unit and the electrode, in which the power supply line includes a lower-side passing portion which passes through a lower side of a placing surface on which the main body part is placed, a first connection portion which is drawn to an upper side than the placing surface and connects the lower-side passing portion and the electrode, and a second connection portion which connects the lower-side passing portion and the power supply unit.

BRIEF DESCRIPTION OF THE DRAWINGS

FIGS. 2A to 2C are enlarged views of the surroundings of an electrode, in which FIG. 2A is a diagram showing a state where the electrode holds a metal pipe material, FIG. 2B is a diagram showing a state where a seal member is pressed against the electrode, and FIG. 2C is a front view of the electrode.

DETAILED DESCRIPTION

Figure 1:
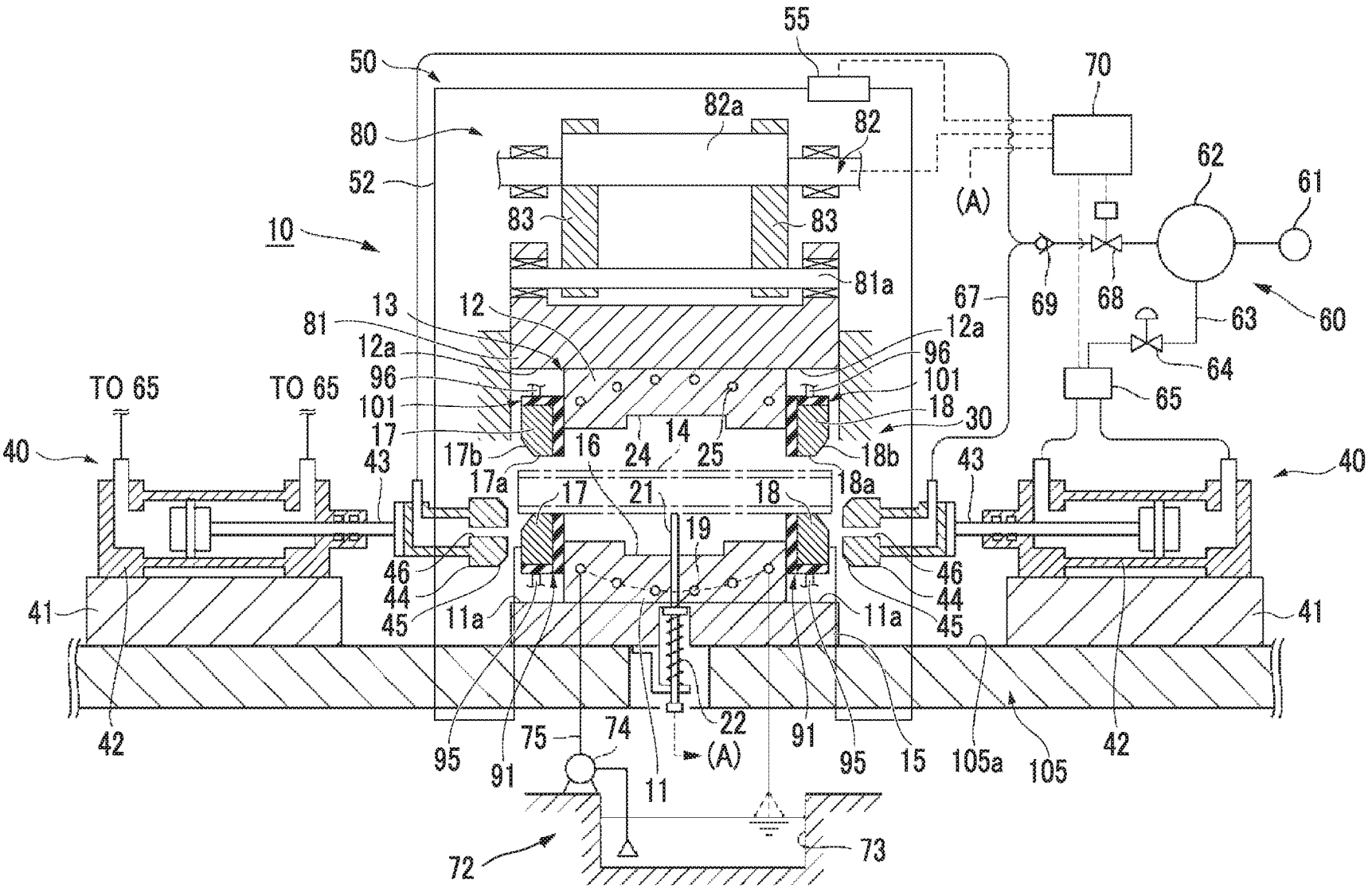
FIG. 1 is a schematic configuration diagram showing a forming apparatus which is used in a forming system according to an embodiment of the present invention.

In the forming apparatus of the related art, the metal pipe material is heated by bringing each electrode into contact with the metal pipe material and performing energization. Therefore, a power supply line for supplying electric power from the power supply unit to the electrode is provided. However, since a large current (for example, several tens of thousands A) flows in the power supply line, there is a case where a leakage magnetic field is generated from the power supply line. There is a case where peripheral equipment in a forming system is affected by such a leakage magnetic field.

Therefore, it is desirable to provide a forming system in which the influence on peripheral equipment of a leakage magnetic field which is generated from a power supply line can be suppressed.

According to this forming system, the power supply line connects the electrode which energizes and heats the metal pipe material and the power supply unit which is disposed at a position separated from the main body part. The power supply line includes the lower-side passing portion which passes through the lower side of the placing surface on the main body part is placed, the first connection portion which is drawn to the upper side of the placing surface and connect the lower-side passing portion and the electrode, and the second connection portion which connects the lower-side passing portion and the power supply unit. In this manner, the power supply line passes through the lower side of the placing surface of the forming die at the lower-side passing portion between the first connection portion and the second connection portion while securing connectivity with the electrode at the first connection portion and securing connectivity with the power supply unit at the second connection portion. In this manner, the lower-side passing portion passes through the lower side of the placing surface, whereby the distance between equipment which is disposed on the placing surface and the lower-side passing portion is increased. Therefore, the influence of a leakage magnetic field from the lower-side passing portion on the equipment which is disposed on the placing surface can be suppressed. By the above, it is possible to suppress the influence on the peripheral equipment of the leakage magnetic field which is generated from the power supply line.

In this forming system, the power supply line may include a positive electrode line and a negative electrode line, and in the lower-side passing portion, the positive electrode line and the negative electrode line may be disposed in parallel at the lower side of the placing surface. In this way, it is possible to dispose the positive electrode line and the negative electrode line in a collected state. The direction of a magnetic field (the direction of a magnetic flux) which is generated by the positive electrode line and the direction of a magnetic field (the direction of a magnetic flux) which is generated by the negative electrode line are opposite to each other. Therefore, the positive electrode line and the negative electrode line are disposed in parallel, whereby it is possible to mutually cancel some magnetic fluxes and further suppress the influence of the leakage magnetic field on peripheral equipment.

In this forming system, a pair of the electrodes may be provided to face each other in a first direction in a horizontal direction so as to support both end sides of the metal pipe material, in a state of being disposed in the forming die, in a longitudinal direction, a die replacement carriage disposition part for allowing a die replacement carriage to advance and retreat may be provided on one side with respect to the main body part in a second direction orthogonal to the first direction in the horizontal direction, a handling unit which performs installation and removal of the metal pipe material with respect to the forming die may be provided on the other side with respect to the main body part in the second direction, and the first connection portion may be drawn to the upper side of the placing surface from a position other than an area on the one side with respect to the main body part in the second direction. In this way, it is possible to prevent the first connection portion from interfering with the die replacement carriage, the forming die, or the like at the time of die replacement.

In this forming system, the first connection portion may be drawn to the upper side of the placing surface from an area on the other side with respect to the main body part in the second direction. In this way, it is possible to prevent the first connection portion from interfering with the die replacement carriage, the forming die, or the like at the time of die replacement. Further, it is not necessary to cause the positive electrode line and the negative electrode line to be greatly branched, compared to a case where the first connection portions are drawn from areas on both sides with respect to the main body part in the first direction, and therefore, the path of the line can be shortened. In this way, it is possible to reduce the resistance of the positive electrode line and the negative electrode line.

In this forming system, the first connection portion may be drawn to the upper side of the placing surface from each of areas on both sides with respect to the main body part in the first direction. In this way, it is possible to prevent the first connection portion from interfering with the die replacement carriage, the forming die, or the like at the time of die replacement. Further, since it is possible to secure spaces at side portions on both sides of the main body part in the second direction, it is possible to dispose peripheral equipment (temperature measuring equipment for measuring the temperature of the die, cooling equipment for cooling the die, or the like) in the spaces.

In this forming system, a cover which covers a portion drawn to the upper side of the placing surface may be provided with respect to at least one of the first connection portion and the second connection portion. In this way, it is possible to suppress the influence of a leakage magnetic field which is generated from the portion of the power supply line, which is drawn to the upper side of the placing surface.

According to the forming system according to the embodiment of the present invention, the influence on peripheral equipment of a leakage magnetic field which is generated from the power supply line can be suppressed.

Hereinafter, a preferred embodiment of a forming system according to the present invention will be described with reference to the drawings. In each drawing, identical or corresponding portions are denoted by the same reference numerals, and overlapping description will be omitted.

<Configuration of Forming Apparatus>

FIG. 1 is a schematic configuration diagram of a forming apparatus which is included in a forming system according to this embodiment. As shown in FIG. 1, a forming apparatus 10 for forming a metal pipe is configured to include a forming die 13 which includes an upper die 12 and a lower die 11, a drive mechanism 80 for moving at least one of the upper die 12 and the lower die 11, a pipe holding mechanism 30 for holding a metal pipe material 14 which is disposed between the upper die 12 and the lower die 11, a heating mechanism 50 for energizing and heating the metal pipe material 14 held by the pipe holding mechanism 30, a gas supply unit 60 for supplying high-pressure gas (gas) into the metal pipe material 14 held between the upper die 12 and the lower die 11 and heated, a pair of gas supply mechanisms 40 and 40 for supplying the gas from the gas supply unit 60 into the metal pipe material 14 held by the pipe holding mechanism 30, a water circulation mechanism 72 for forcibly water-cooling the forming die 13, and a control unit 70 that controls the drive of the drive mechanism 80, the drive of the pipe holding mechanism 30, the drive of the heating mechanism 50, and the gas supply of the gas supply unit 60.

The lower die 11 which is one side of the forming die 13 is fixed to a base 15. The lower die 11 is formed of a large steel block and is provided with, for example, a rectangular cavity (recessed portion) 16 on the upper surface thereof. A cooling water passage 19 is formed in the lower die 11, and the lower die 11 is provided with a thermocouple 21 inserted from below at substantially the center. The thermocouple 21 is supported by a spring 22 so as to be movable up and down.

Further, a space 11*a* is provided in the vicinity of each of the right and left ends (right and left ends in FIG. 1) of the lower die 11, and electrodes 17 and 18 (lower electrodes) (described later), which are movable parts of the pipe holding mechanism 30, and the like are disposed in the spaces 11*a* so as to be able to move up and down. Then, the metal pipe material 14 is placed on the lower electrodes 17 and 18, whereby the lower electrodes 17 and 18 come into contact with the metal pipe material 14 which is disposed between the upper die 12 and the lower die 11. In this way, the lower electrodes 17 and 18 are electrically connected to the metal pipe material 14.

Insulating materials 91 for preventing electric conduction are provided between the lower die 11 and the lower electrode 17, below the lower electrode 17, between the lower die 11 and the lower electrode 18, and below the lower electrode 18. Each insulating material 91 is fixed to an advancing and retracting rod 95 which is a movable portion of an actuator (not shown) configuring the pipe holding mechanism 30. The actuator is for moving the lower electrodes 17 and 18 and the like up and down, and a fixed portion of the actuator is held on the base 15 side together with the lower die 11.

The upper die 12 which is the other side of the forming die 13 is fixed to a slide 81 (described later) configuring the drive mechanism 80. The upper die 12 is formed of a large steel block and has a cooling water passage 25 formed in the interior thereof and, for example, a rectangular cavity (recessed portion) 24 provided on the lower surface thereof. The cavity 24 is provided at a position facing the cavity 16 of the lower die 11.

Similar to the lower die 11, a space 12*a* is provided in the vicinity of each of the right and left ends (right and left ends in FIG. 1) of the upper die 12, and electrodes 17 and 18 (upper electrodes) (described later), which are movable parts of the pipe holding mechanism 30, and the like are disposed in the spaces 12*a* so as to be movable up and down. Then, the upper electrodes 17 and 18 move downward in a state where the metal pipe material 14 is placed on the lower electrodes 17 and 18, whereby the upper electrodes 17 and 18 come into contact with the metal pipe material 14 disposed between the upper die 12 and the lower die 11. In this way, the upper electrodes 17, 18 are electrically connected to the metal pipe material 14.

Insulating materials 101 for preventing electric conduction are provided between the upper die 12 and the upper electrode 17, above the upper electrode 17, between the upper die 12 and the upper electrode 18, and above the upper electrode 18. Each insulating material 101 is fixed to an advancing and retracting rod 96 which is a movable portion of the actuator configuring the pipe holding mechanism 30. The actuator is for moving the upper electrodes 17 and 18 and the like up and down, and a fixed portion of the actuator is held on the slide 81 side of the drive mechanism 80 together with the upper die 12.

A semicircular arc-shaped concave groove 18*a* corresponding to the outer peripheral surface of the metal pipe material 14 is formed in each of the surfaces of the electrodes 18 and 18, which face each other, in the right side portion of the pipe holding mechanism 30 (refer to FIGS. 2A to 2C), and the metal pipe material 14 can be placed so as to exactly fit to the portion of the concave groove 18*a*. Similar to the concave groove 18*a*, a semicircular arc-shaped concave groove corresponding to the outer peripheral surface of the metal pipe material 14 is formed in each of exposed surfaces of the insulating materials 91 and 101, which face each other, in the right side portion of the pipe holding mechanism 30. Further, a tapered concave surface 18*b* in which the periphery is recessed to be inclined in a tapered shape toward the concave groove 18*a* is formed on the front surface of the electrode 18 (the surface in an outer direction of the die). Accordingly, a configuration is made such that, if the metal pipe material 14 is clamped from an up-down direction at the right side portion of the pipe holding mechanism 30, the outer periphery of the right end portion of the metal pipe material 14 can be exactly surrounded so as to be in close contact over the entire circumference.

A semicircular arc-shaped concave groove 17*a* corresponding to the outer peripheral surface of the metal pipe material 14 is formed in each of the surfaces of the electrodes 17 and 17, which face each other, in the left side portion of the pipe holding mechanism 30 (refer to FIGS. 2A to 2C), and the metal pipe material 14 can be placed so as to exactly fit to the portion of the concave groove 17*a*. Similar to the concave groove 18*a*, a semicircular arc-shaped concave groove corresponding to the outer peripheral surface of the metal pipe material 14 is formed in each of exposed surfaces of the insulating materials 91 and 101, which face each other, in the left side portion of the pipe holding mechanism 30. Further, a tapered concave surface 17*b* in which the periphery is recessed to be inclined in a tapered shape toward the concave groove 17*a* is formed on the front surface of the electrode 17 (the surface in the outer direction of the die). Accordingly, a configuration is made such that, if the metal pipe material 14 is clamped from the up-down direction at the left side portion of the pipe holding mechanism 30, the outer periphery of the left end portion of the metal pipe material 14 can be exactly surrounded so as to be in close contact over the entire circumference.

As shown in FIG. 1, the drive mechanism 80 includes the slide 81 for moving the upper die 12 such that the upper die 12 and the lower die 11 are combined with each other, a shaft 82 for generating a driving force for moving the slide 81, and a connecting rod 83 for transmitting the driving force generated by the shaft 82 to the slide 81. The shaft 82 extends in a right-left direction above the slide 81, is rotatably supported, and has an eccentric crank 82*a* which protrudes from the right and left ends and extends in the right-left direction at a position separated from the shaft center thereof. The eccentric crank 82*a* and a rotary shaft 81*a* provided above the slide 81 and extending in the right-left direction are connected to each other by the connecting rod 83. In the drive mechanism 80, the height in the up-down direction of the eccentric crank 82*a* is changed by controlling the rotation of the shaft 82 by the control unit 70, and the up-and-down movement of the slide 81 can be controlled by transmitting the positional change of the eccentric crank 82*a* to the slide 81 through the connecting rod 83. Here, the oscillation (rotational movement) of the connecting rod 83, which occurs when the positional change of the eccentric crank 82*a* is transmitted to the slide 81, is absorbed by the rotary shaft 81*a*. The shaft 82 rotates or stops in response to the drive of a motor or the like, which is controlled by the control unit 70, for example.

The heating mechanism 50 includes a power supply unit 55, and a power supply line 52 which electrically connects the power supply unit 55 and the electrodes 17 and 18. The power supply unit 55 includes a direct-current power supply and a switch, and can energize the metal pipe material 14 through the power supply line 52 and the electrodes 17 and 18 in a state where the electrodes 17 and 18 are electrically connected to the metal pipe material 14. Here, the power supply line 52 is connected to the lower electrodes 17 and 18.

In the heating mechanism 50, the direct-current current output from the power supply unit 55 is transmitted by the power supply line 52 and input to the electrode 17. Then, the direct-current current passes through the metal pipe material 14 and is input to the electrode 18. Then, a direct-current current is transmitted by the power supply line 52 and input to the power supply unit 55.

Figure 2A:
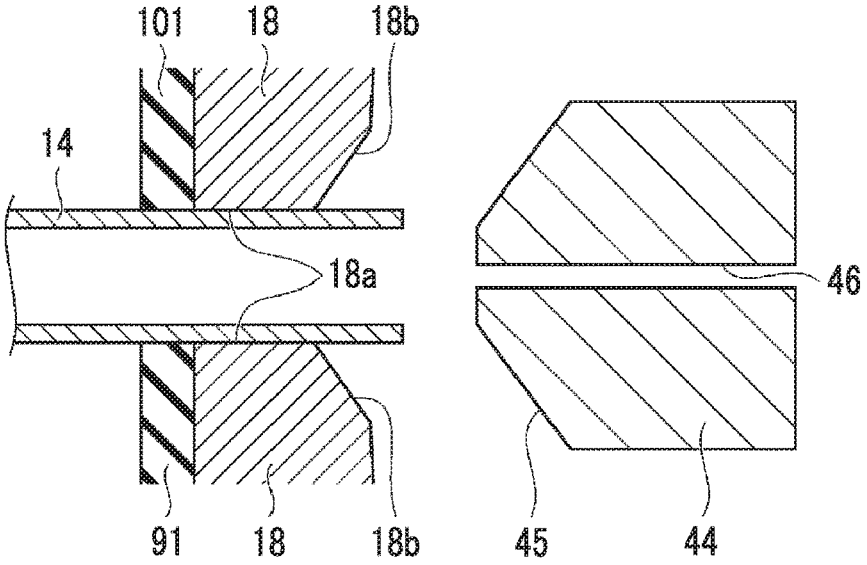
Figure 2B:
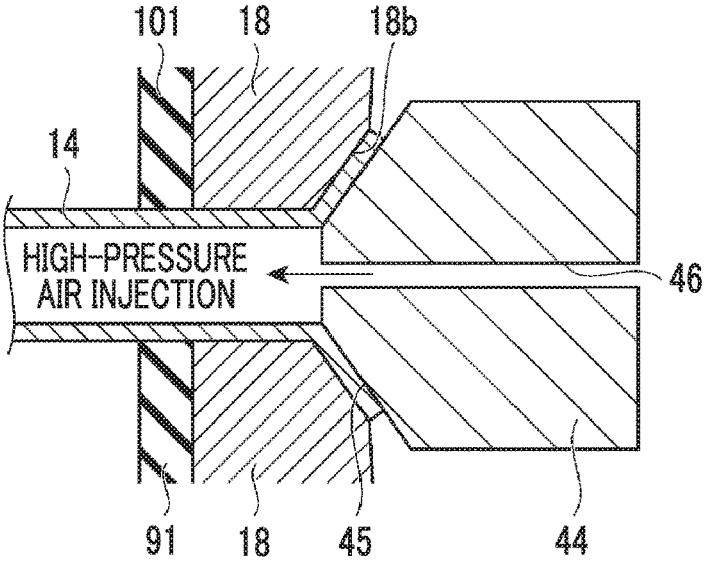
Figure 2C:
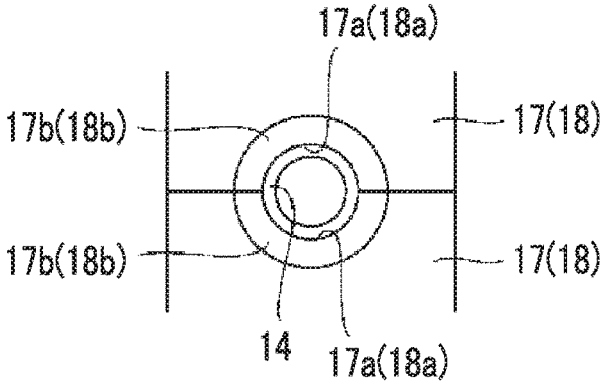

Returning to FIG. 1, each of the pair of gas supply mechanisms 40 includes a cylinder unit 42, a cylinder rod 43 which advances and retreats in accordance with the operation of the cylinder unit 42, and a seal member 44 connected to the tip of the cylinder rod 43 on the pipe holding mechanism 30 side. The cylinder unit 42 is placed on and fixed to a block 41. A tapered surface 45 which is tapered is formed on the tip of the seal member 44, and is configured in a shape which is fitted to the tapered concave surfaces 17*b* and 18*b* of the electrodes 17 and 18 (refer to FIGS. 2A and 2B). A gas passage 46 which extends from the cylinder unit 42 side toward the tip and through which the high-pressure gas supplied from the gas supply unit 60 flows, as specifically shown in detail in FIGS. 2A and 2B, is provided in the seal member 44.

The gas supply unit 60 includes a gas source 61, an accumulator 62 for storing the gas supplied by the gas source 61, a first tube 63 extending from the accumulator 62 to the cylinder unit 42 of the gas supply mechanism 40, a pressure control valve 64 and a switching valve 65 provided in the first tube 63, a second tube 67 extending from the accumulator 62 to the gas passage 46 formed in the seal member 44, and a pressure control valve 68 and a check valve 69 provided in the second tube 67. The pressure control valve 64 plays a role of supplying a gas having an operating pressure adapted to a pressing force of the seal member 44 against the metal pipe material 14 to the cylinder unit 42.

The check valve 69 plays a role of preventing the high-pressure gas from flowing backward in the second tube 67. The pressure control valve 68 provided in the second tube 67 plays a role of supplying a gas having an operating pressure for expanding the metal pipe material 14 to the gas passage 46 of the seal member 44 by the control of the control unit 70.

The control unit 70 can supply a gas having a desired operating pressure into the metal pipe material 14 by controlling the pressure control valve 68 of the gas supply unit 60. Further, the control unit 70 acquires temperature information from the thermocouple 21 from information which is transmitted from (A) shown in FIG. 1, and controls the drive mechanism 80, the power supply unit 55, and the like.

The water circulation mechanism 72 includes a water tank 73 for storing water, a water pump 74 for pumping up the water stored in the water tank 73, pressurizing it, and sending it to the cooling water passage 19 of the lower die 11 and the cooling water passage 25 of the upper die 12, and a pipe 75. Although omitted, a cooling tower for lowering a water temperature or a filter for purifying water may be provided in the pipe 75.

<Method of Forming Metal Pipe using Forming Apparatus>

Next, a method of forming a metal pipe using the forming apparatus 10 will be described. First, the quenchable steel grade cylindrical metal pipe material 14 is prepared. The metal pipe material 14 is placed (loaded) on the electrodes 17 and 18 provided on the lower die 11 side by using, for example, a robot arm or the like. Since the concave grooves 17*a* and 18*a* are formed in the electrodes 17 and 18, the metal pipe material 14 is positioned by the concave grooves 17*a* and 18*a*.

Next, the control unit 70 controls the drive mechanism 80 and the pipe holding mechanism 30, thereby causing the pipe holding mechanism 30 to hold the metal pipe material 14. Specifically, the upper die 12, the upper electrodes 17 and 18, and the like held on the slide 81 side move to the lower die 11 side by the drive of the drive mechanism 80, and both end portions of the metal pipe material 14 are clamped from above and below by the pipe holding mechanism 30 by operating the actuator which allows the upper electrodes 17 and 18 and the like and the lower electrodes 17 and 18 and the like, which are included in the pipe holding mechanism 30, to advance and retreat. The clamping is performed in such an aspect as to be in close contact over the entire circumference in the vicinity of both end portions of the metal pipe material 14 due to the presence of the concave grooves 17*a* and 18*a* formed in the electrodes 17 and 18 and the concave grooves formed in the insulating materials 91 and 101.

At this time, as shown in FIG. 2A, the end portion of the metal pipe material 14 on the electrode 18 side protrudes further toward the seal member 44 side than the boundary between the concave groove 18*a* of the electrode 18 and the tapered concave surface 18*b* in an extending direction of the metal pipe material 14. Similarly, the end portion of the metal pipe material 14 on the electrode 17 side protrudes further toward the seal member 44 side than the boundary between the concave groove 17*a* of the electrode 17 and the tapered concave surface 17*b* in the extending direction of the metal pipe material 14. Further, the lower surfaces of the upper electrodes 17 and 18 and the upper surfaces of the lower electrodes 17 and 18 are in contact with each other. However, there is no limitation to the configuration of being in close contact over the entire circumference of each of both end portions of the metal pipe material 14, and a configuration may be made such that the electrodes 17 and 18 are in contact with a part in the circumferential direction of the metal pipe material 14.

Subsequently, the control unit 70 controls the heating mechanism 50 to heat the metal pipe material 14. Specifically, the control unit 70 controls the power supply unit 55 of the heating mechanism 50 to supply electric power. Then, the electric power which is transmitted to the lower electrodes 17 and 18 through the power supply line 52 is supplied to the upper electrodes 17 and 18 clamping the metal pipe material 14 and the metal pipe material 14, and due to resistance which exists in the metal pipe material 14, the metal pipe material 14 itself generates heat by Joule heat. That is, the metal pipe material 14 is in the energized and heated state.

Subsequently, the forming die 13 is closed to the heated metal pipe material 14 by the control of the drive mechanism 80 by the control unit 70. In this way, the cavity 16 of the lower die 11 and the cavity 24 of the upper die 12 are combined, and the metal pipe material 14 is disposed and sealed in the cavity portion between the lower die 11 and the upper die 12.

Thereafter, the both ends of the metal pipe material 14 are sealed by advancing the seal member 44 by operating the cylinder unit 42 of the gas supply mechanism 40. At this time, as shown in FIG. 2B, the seal member 44 is pressed against the end portion of the metal pipe material 14 on the electrode 18 side, whereby the portion protruding further toward the seal member 44 than the boundary between the concave groove 18*a* and the tapered concave surface 18*b* of the electrode 18 is deformed in a funnel shape so as to follow the tapered concave surface 18*b*. Similarly, the seal member 44 is pressed against the end portion of the metal pipe material 14 on the electrode 17 side, whereby the portion protruding further toward the seal member 44 than the boundary between the concave groove 17*a* and the tapered concave surface 17*b* of the electrode 17 is deformed in a funnel shape so as to follow the tapered concave surface 17*b*. After the completion of the sealing, a high-pressure gas is blown into the metal pipe material 14 to form the metal pipe material 14 softened by heating so as to follow the shape of the cavity portion.

The metal pipe material 14 is softened by being heated to a high temperature (about 950° C.), and therefore, the gas supplied into the metal pipe material 14 thermally expands. For this reason, for example, the gas to be supplied is set to be compressed air, and thus the metal pipe material 14 having a temperature of 950° C. can be easily expanded by the thermally expanded compressed air.

The outer peripheral surface of the blow-formed and expanded metal pipe material 14 is rapidly cooled in contact with the cavity 16 of the lower die 11 and at the same time, is rapidly cooled in contact with the cavity 24 of the upper die 12 (since the upper die 12 and the lower die 11 have large heat capacity and are controlled to a low temperature, if the metal pipe material 14 comes into contact with the upper die 12 and the lower die 11, the heat of the pipe surface is removed to the die side at once), and thus quenching is performed. Such a cooling method is called die contact cooling or die cooling. Immediately after the rapid cooling, austenite is transformed into martensite (hereinafter, the transformation of austenite to martensite is referred to as martensitic transformation). Since a cooling rate is reduced in the second half of the cooling, the martensite is transformed into another structure (troostite, sorbite, or the like) due to reheating. Therefore, it is not necessary to separately perform tempering treatment. Further, in this embodiment, instead of the die cooling or in addition to the die cooling, cooling may be performed by supplying a cooling medium into, for example, the cavity 24. For example, the martensitic transformation may be generated by performing cooling by bringing the metal pipe material 14 into contact with the dies (the upper die 12 and the lower die 11) before a temperature at which the martensitic transformation begins, and then performing the die opening and blowing a cooling medium (cooling gas) to the metal pipe material 14.

As described above, the metal pipe material 14 is blow-formed and then cooled, and then the die opening is performed, thereby obtaining a metal pipe having, for example, a substantially rectangular tubular main body portion.

Figure 3:
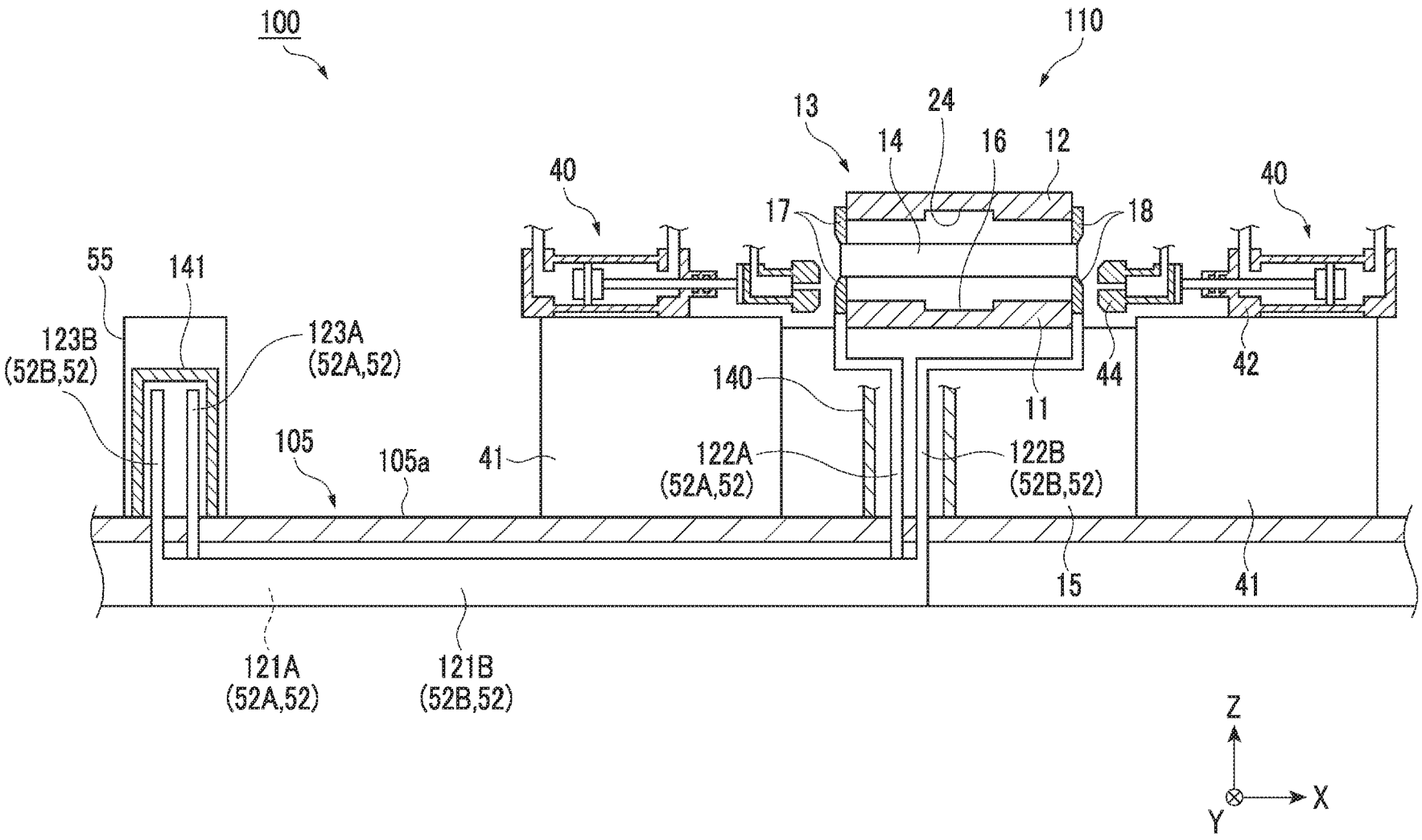
FIG. 3 is a schematic sectional view of the forming system according to the embodiment.
Figure 4:
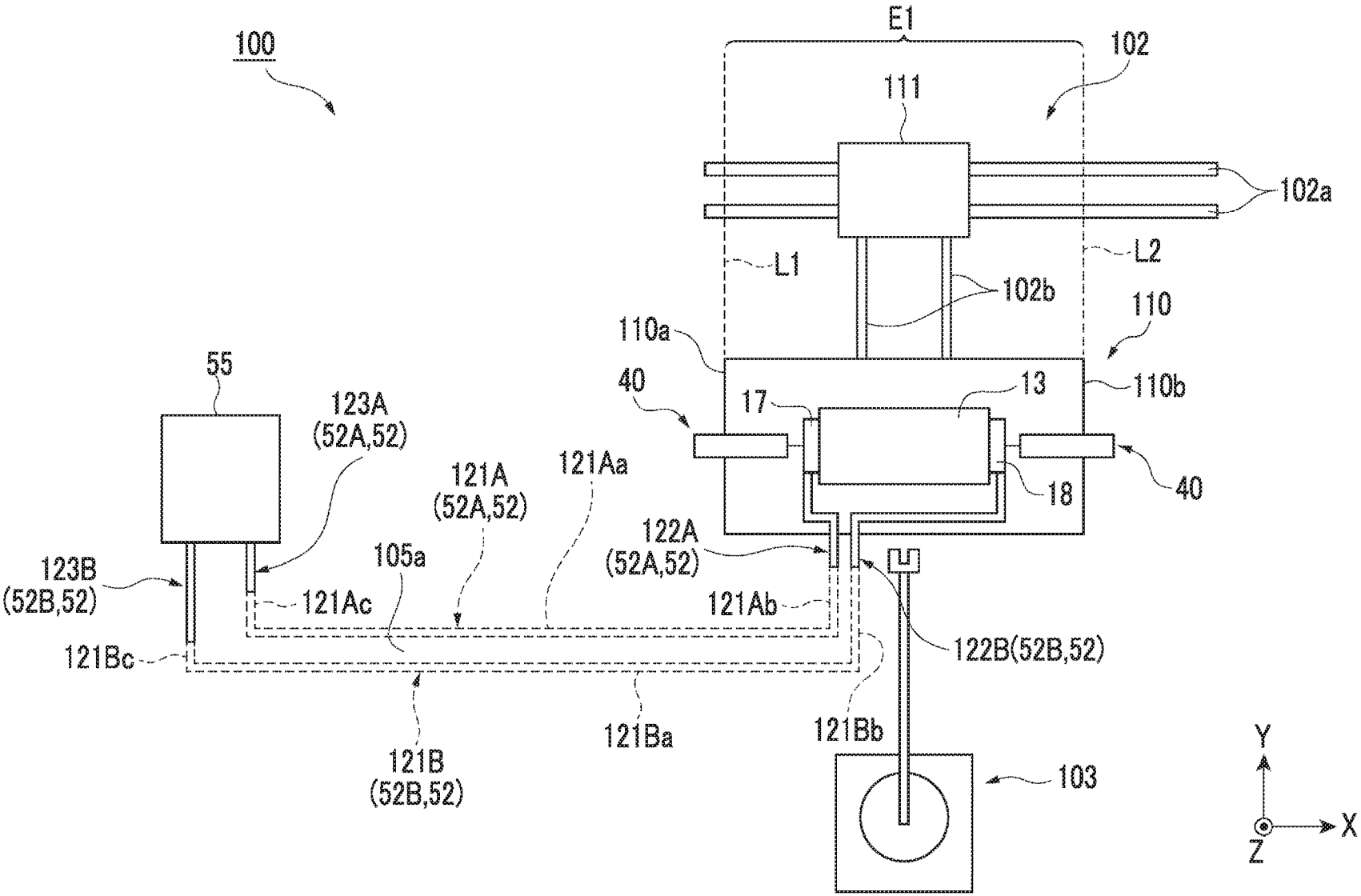
FIG. 4 is a schematic plan view of the forming system shown in FIG. 3.

Next, a forming system 100 according to this embodiment will be described with reference to FIGS. 3 to 5. As shown in FIGS. 3 and 4, the forming system 100 includes the forming apparatus 10 which includes the forming die 13, the electrodes 17 and 18, the power supply unit 55, and the power supply line 52, a placing table 105, a die replacement carriage disposition part 102 (refer to FIG. 4), and a handling unit 103 (refer to FIG. 4). The unit including the forming die 13, the base 15, the gas supply mechanism 40, the block 41, and the drive mechanism 80 (refer to FIG. 1) is referred to as a main body part 110 of the forming system 100. The pair of gas supply mechanisms 40 and the blocks 41 are disposed to interpose the base 15 therebetween. In the placing table 105, the main body part 110, the power supply unit 55, the die replacement carriage disposition part 102, and the handling unit 103 are placed on a placing surface 105*a* (refer to FIG. 4).

In this embodiment, a direction in which the electrodes 17 and 18 face each other in the horizontal direction is set to be an "X-axis direction", a direction orthogonal to the X-axis direction in the horizontal direction is set to be a "Y-axis direction", and the up-down direction is set to be a "Z-axis direction". Further, the electrode 18 side is set to be a positive side in the X-axis direction, and the electrode 17 side is set to be a negative side in the X-axis direction. One side in the Y-axis direction is set to be a positive side, and the other side in the Y-axis direction is set to be a negative side. The upper side is set to be a positive side in the Z-axis direction, and the lower side is set to be a negative side in the Z-axis direction. The X-axis direction corresponds to a "first direction" in the claims, and the Y-axis direction corresponds to a "second direction" in the claims.

As shown in FIG. 4, the die replacement carriage disposition part 102 is a structure for allowing a die replacement carriage 111 to advance and retreat. The die replacement carriage disposition part 102 is provided on the positive side with respect to the main body part 110 in the Y-axis direction. The die replacement carriage disposition part 102 includes a rail part 102*a* for allowing the die replacement carriage 111 to advance and retreat in the X axis direction, and a rail part 102*b* for allowing the die replacement carriage 111 to advance and retreat in the Y axis direction. The rail part 102*a* is provided at a position separated from the main body part 110 to the positive side in the Y-axis direction. The rail part 102*b* extends in the Y-axis direction from the rail part 102*a* to the position on the front side of the main body part 110.

The handling unit 103 is a device for performing installation and removal of the metal pipe material 14 with respect to the forming die 13. The handling unit 103 is configured of, for example, a robot arm. The handling unit 103 is provided on the negative side with respect to the main body part 110 in the Y-axis direction.

The power supply unit 55 is disposed at a position separated from the main body part 110 and is a device for supplying electric power to the electrodes 17 and 18 through the power supply line 52. In this embodiment, the power supply line is configured of a bus bar. In a case where the electrode 17 is set to be a positive electrode and the electrode 18 is set to be a negative electrode, the power supply line 52 includes a positive electrode line 52A connecting the power supply unit 55 and the electrode 17, and a negative electrode line 52B connecting the power supply unit 55 and the electrode 18. However, there is no particular limitation on which of the electrode 17 and the electrode 18 is set as a positive electrode or a negative electrode. Therefore, the electrode 17 may be set as a negative electrode and the electrode 18 may be set as a positive electrode. In this case, the line 52A serves as a negative electrode line and the line 52B serves as a positive electrode line.

Next, schematic disposition of the power supply line 52 will be described with reference to FIG. 3. The power supply line 52 shown in FIG. 3 schematically shows a positional relationship with other constituent elements. As shown in FIG. 3, the positive electrode line 52A and the negative electrode line 52B of the power supply line 52 respectively include lower-side passing portions 121A and 121B, first connection portions 122A and 122B, and second connection portions 123A and 123B. The lower-side passing portions 121A and 121B are portions which pass through the lower side of the placing surface 105*a* of the placing table 105. The first connection portions 122A and 122B are portions which connect the lower-side passing portions 121A and 121B and the electrodes 17 and 18, respectively. The second connection portions 123A and 123B are portions which connect the lower-side passing portions 121A and 121B and the power supply unit 55.

The first connection portions 122A and 122B are drawn to the upper side of the placing surface 105*a*. The second connection portions 123A and 123B are drawn to the upper side of the placing surface 105*a*. With respect to the first connection portions 122A and 122B, a cover 140 which covers the whole or a part of the portion which is drawn to the upper side of the placing surface 105*a* is provided. In FIG. 3, apart of the cover 140 is omitted in order to show the configuration around the forming die 13. With respect to the second connection portions 123A and 123B, a cover 141 which covers the whole or a part of the portion which is drawn to the upper side of the placing surface 105*a* is provided.

Next, the detailed configurations of the positive electrode line 52A and the negative electrode line 52B of the power supply line 52 will be described with reference to FIGS. 4 and 5. The portions shown by broken lines in FIGS. 4 and 5 are portions which are disposed below the placing surface 105*a*. In FIGS. 4 and 5, the covers 140 and 141 are omitted. In FIG. 5, in order to clarify the shape of the power supply line 52, only the power supply line 52, the electrodes 17 and 18, and the power supply unit 55 are shown.

Figure 5:
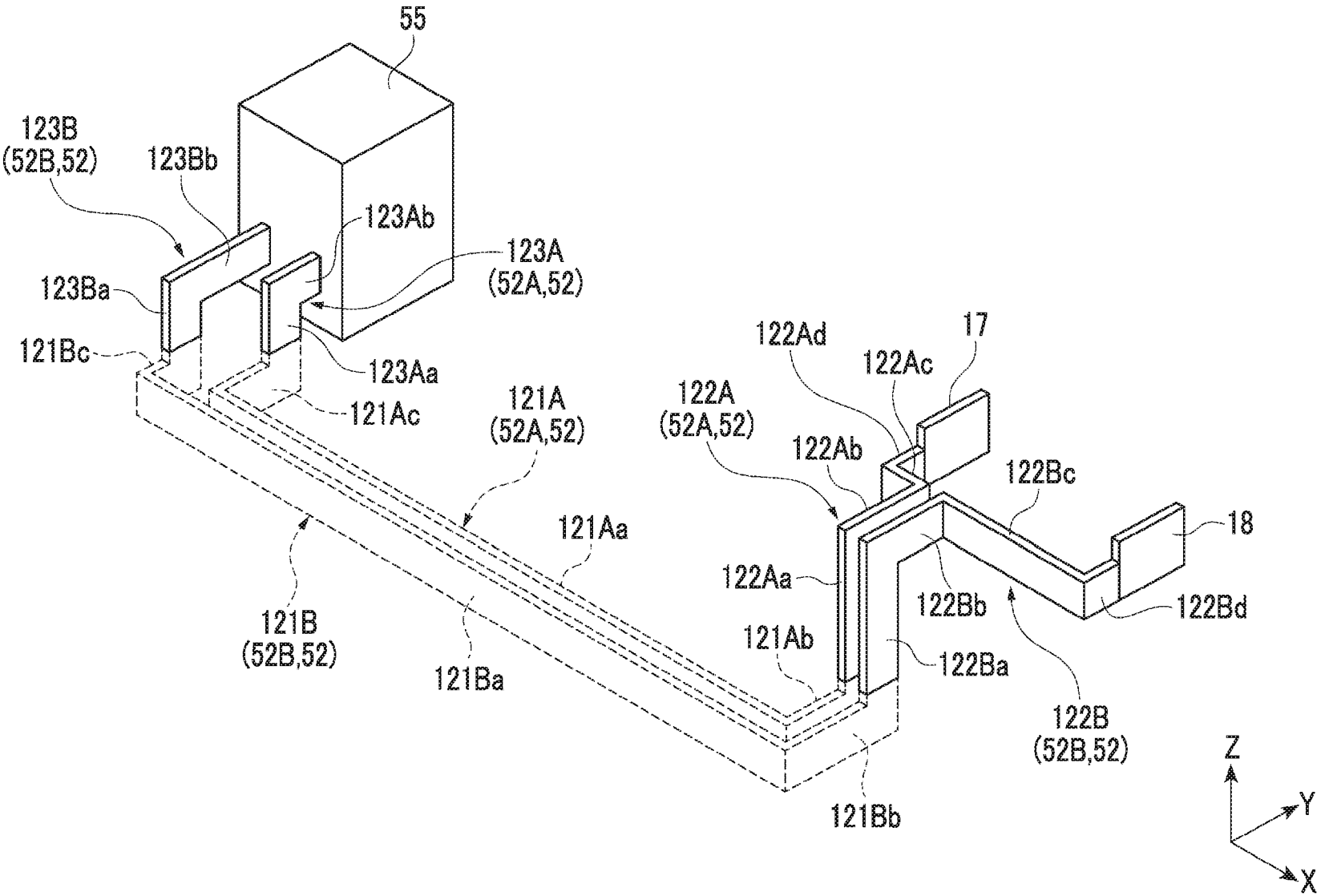
FIG. 5 is a perspective view showing a power supply line of the forming system shown in FIG. 3.

As shown in FIGS. 4 and 5, in this embodiment, the power supply unit 55 is disposed at a position separated from the main body part 110 to the negative side in the X-axis direction. The lower-side passing portions 121A and 121B are disposed at positions separated further toward the negative side in the Y-axis direction than the main body part 110 and the power supply unit 55. The first connection portions 122A and 122B are drawn upward from the end portions on the positive side in the X-axis direction of the lower-side passing portions 121A and 121B, and are connected to the electrodes 17 and 18, respectively. Further, the second connection portions 123A and 123B are drawn upward from the end portions on the negative side in the X-axis direction of the lower-side passing portions 121A and 121B, and are connected to the power supply unit 55. Each portion of the positive electrode line 52A and the negative electrode line 52B in the following description is configured of a long plate member extending in a state of having a thickness direction in any direction in the horizontal direction.

Specifically, the lower-side passing portions 121A and 121B include straight portions 121Aa and 121Ba, bent portions 121Ab and 121Bb, and bent portions 121Ac and 121Bc. The straight portions 121Aa and 121Ba are portions which extend straight in the X-axis direction. The bent portions 121Ab and 121Bb are portions which are bent from the end portions on the positive side in the X-axis direction of the straight portions 121Aa and 121Ba to the positive side in the Y-axis direction toward the main body part 110. The bent portions 121Ac and 121Bc are portions which are bent from the end portions on the negative side in the X-axis direction of the straight portions 121Aa and 121Ba to the positive side in the Y-axis direction toward the power supply unit 55. The straight portion 121Aa is disposed further on the positive side in the Y-axis direction than the straight portion 121Ba. The bent portion 121Ab is disposed further on the negative side in the X-axis direction than the bent portion 121Bb. The bent portion 121Ac is disposed further on the positive side in the X-axis direction than the bent portion 121Bc.

The first connection portions 122A and 122B extend upward from the end portions of the lower-side passing portions 121A and 121B, extend toward the positive side in the Y-axis direction toward the main body part 110, are branched from each other on the front side of the main body part 110, and are connected to the electrode 17 and the electrode 18, respectively. Specifically, the first connection portions 122A and 122B include rising portions 122Aa and 122Ba, straight portions 122Ab and 122Bb, branched portions 122Ac and 122Bc, and connection portions 122Ad and 122Bd. The rising portions 122Aa and 122Ba are portions which extend straight upward from the end portions on the positive side in the Y-axis direction of the bent portions 121Ab and 121Bb of the lower-side passing portions 121A and 121B. The rising portions 122Aa and 122Ba extend to the height positions of the electrodes 17 and 18. The straight portions 122Ab and 122Bb extend straight from the upper end portions of the rising portions 122Aa and 122Ba to the front side of the forming die 13 toward the positive side in the Y-axis direction. The first connection portions 122A and 122B are branched so as to extend in the opposite directions to each other at the branch portions 122Ac and 122Bc. That is, the branch portion 122Ac extends from the end portion on the positive side in the Y-axis direction of the straight portion 122Ab to the negative side in the X-axis direction. The connection portion 122Ad extends from the end portion on the negative side in the X-axis direction of the branch portion 122Ac to the positive side in the Y-axis direction and is connected to the electrode 17. The branch portion 122Bc extends from the end portion on the positive side in the Y-axis direction of the straight portion 122Bb to the positive side in the X-axis direction. The connection portion 122Bd extends from the end portion on the positive side in the X-axis direction of the branch portion 122Bc to the positive side in the Y-axis direction and is connected to the electrode 18. The branch portions 122Ac and 122Bc branch at positions closer to the electrode 17. Therefore, the length of the branch portion 122Bc is longer than that of the branch portion 122Ac.

The second connection portions 123A and 123B extend upward from the end portions of the lower-side passing portions 121A and 121B, extend toward the positive side in the Y-axis direction toward the power supply unit 55, and are connected to the power supply unit 55. Specifically, the second connection portions 123A and 123B include rising portions 123Aa and 123Ba, and connection portions 123Ab and 123Bb. The rising portions 123Aa and 123Ba extend to the height positions of the electrodes 17 and 18. The connection portions 123Ab and 123Bb extend from the upper end portions of the rising portions 123Aa and 123Ba toward the positive side in the Y-axis direction and are connected to the power supply unit 55.

In the lower-side passing portions 121A and 121B, the positive electrode line 52A and the negative electrode line 52B are disposed in parallel at the lower side of the placing surface 105*a*. That is, in the lower-side passing portions 121A and 121B, the straight portions 121Aa and 121Ba, the bent portions 121Ab and 121Bb, and the bent portions 121Ac and 121Bc are disposed to extend in parallel with a predetermined gap therebetween. Also in the first connection portions 122A and 122B, the rising portions 122Aa and 122Ba and the straight portions 122Ab and 122Bb are disposed to extend in parallel with a predetermined gap therebetween.

Here, as described above, the die replacement carriage disposition part 102 is disposed at an area on the positive side with respect to the main body part 110 in the Y-axis direction. The area is set to be an area E1 between both the end portions 110*a* and 110*b* in the X-axis direction of the main body part 110 (in FIG. 4, an area between a straight line L1 and a straight line L2). The first connection portions 122A and 122B are drawn to the upper side of the placing surface 105*a* from positions other than the area E1. In this embodiment, the first connection portions 122A and 122B are drawn to the upper side of the placing surface 105*a* from the area on the negative side with respect to the main body part 110 in the Y-axis direction. That is, the first connection portions 122A and 122B are drawn to the upper side of the placing surface 105*a* from an area where the handling unit 103 is disposed, not at the die replacement carriage disposition part 102.

Next, the operation and effects of the forming system 100 according to this embodiment will be described.

According to the forming system 100 of this embodiment, the power supply line 52 connects the electrodes 17 and 18 which energize and heat the metal pipe material 14 and the power supply unit 55 which is disposed at a position separated from the main body part 110. The power supply line 52 includes the lower-side passing portions 121A and 121B which pass through the lower side of the placing surface 105*a* on which the main body part 110 is placed, the first connection portions 122A and 122B which are drawn to the upper side of the placing surface 105*a* and connect the lower-side passing portions 121A and 121B and the electrodes 17 and 18, and the second connection portions 123A, 123B which connect the lower-side passing portions 121A and 121B and the power supply unit 55. In this manner, the power supply line 52 passes through the lower side of the placing surface 105*a* of the forming die 13 at the lower-side passing portions 121A and 121B between the first connection portions 122A and 122B and the second connection portions 123A and 123B while securing connectivity with the electrodes 17 and 18 at the first connection portions 122A and 122B and securing connectivity with the power supply unit 55 at the second connection portions 123A and 123B. In this manner, the lower-side passing portions 121A and 121B pass through the lower side of the placing surface 105*a*, whereby the distance between equipment which is disposed on the placing surface 105*a* and the lower-side passing portions 121A and 121B is increased. Therefore, the influence of a leakage magnetic field from the lower-side passing portions 121A and 121B on the equipment which is disposed on the placing surface 105*a* can be suppressed. By the above, it is possible to suppress the influence on the peripheral equipment of the leakage magnetic field which is generated from the power supply line.

Further, the power supply line 52 has the lower-side passing portions 121A and 121B, whereby the space above the placing surface 105*a* can be widely used. Further, the movement of a worker also becomes easy.

In the forming system 100, the power supply line 52 includes the positive electrode line 52A and the negative electrode line 52B, and in the lower-side passing portions 121A and 121B, the positive electrode line 52A and the negative electrode line 52B are disposed in parallel at the lower side of the placing surface 105*a*. In this way, it is possible to dispose the positive electrode line 52A and the negative electrode line 52B in a collected state. The direction of a magnetic field (the direction of a magnetic flux) which is generated by the positive electrode line 52A and the direction of a magnetic field (the direction of a magnetic flux) which is generated by the negative electrode line 52B are opposite to each other. Therefore, the positive electrode line 52A and the negative electrode line 52B are disposed in parallel, whereby it is possible to mutually cancel some magnetic fluxes and further suppress the influence of the leakage magnetic field on the peripheral equipment.

In the forming system 100, the electrodes 17 and 18 are provided in a pair to face each other in the X-axis direction so as to support both end sides in the longitudinal direction of the metal pipe material 14 in a state of being disposed in the forming die 13, the die replacement carriage disposition part 102 for allowing the die replacement carriage 111 to advance and retreat is provided on the positive side with respect to the main body part 110 in the Y-axis direction, the handling unit 103 which performs installation and removal of the metal pipe material 14 with respect to the forming die 13 is provided on the negative side with respect to the main body part 110 in the Y-axis direction, and the first connection portions 122A and 122B are drawn to the upper side of the placing surface 105*a* from positions other than the area E1 on the positive side with respect to the main body part 110 in the Y-axis direction. In this way, it is possible to prevent the first connection portions 122A and 122B from interfering with the die replacement carriage 111, the forming die 13, or the like at the time of die replacement.

Figure 9:
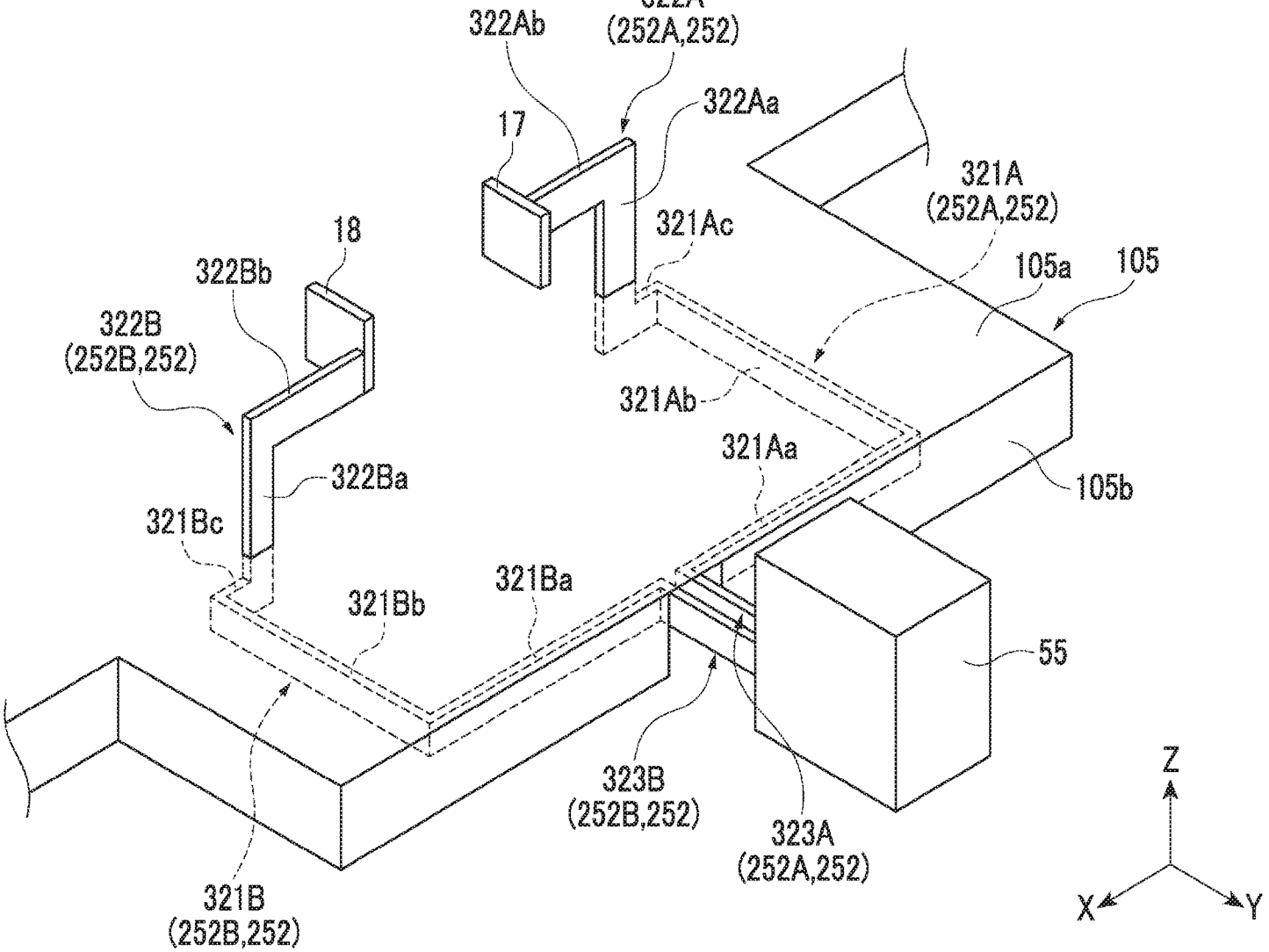
FIG. 9 is a perspective view showing a power supply line of the forming system according to the modification example.

In the forming system 100, the first connection portions 122A and 122B are drawn to the upper side of the placing surface 105*a* from the area on the negative side with respect to the main body part 110 in the Y-axis direction. In this way, it is possible to prevent the first connection portions 122A and 122B from interfering with the die replacement carriage 111, the forming die 13, or the like at the time of die replacement. Further, it is not necessary to cause the positive electrode line 52A and the negative electrode line 52B to be greatly branched, compared to a case where the first connection portions 122A and 122B are drawn from areas on both sides with respect to the main body part 110 in the X-axis direction, as shown in FIG. 9, and therefore, the path of the line can be shortened. In this way, it is possible to reduce the resistance of the positive electrode line 52A and the negative electrode line 52B.

In the forming system 100, the covers 140 and 141 which cover the portions drawn to the upper side of the placing surface 105*a* are provided with respect to the first connection portions 122A and 122B and the second connection portions 123A and 123B. In this way, it is possible to suppress the influence of the leakage magnetic field which is generated from the portion of the power supply line 52, which is drawn to the upper side of the placing surface 105*a*.

The present invention is not limited to the embodiments described above.

Figure 6:
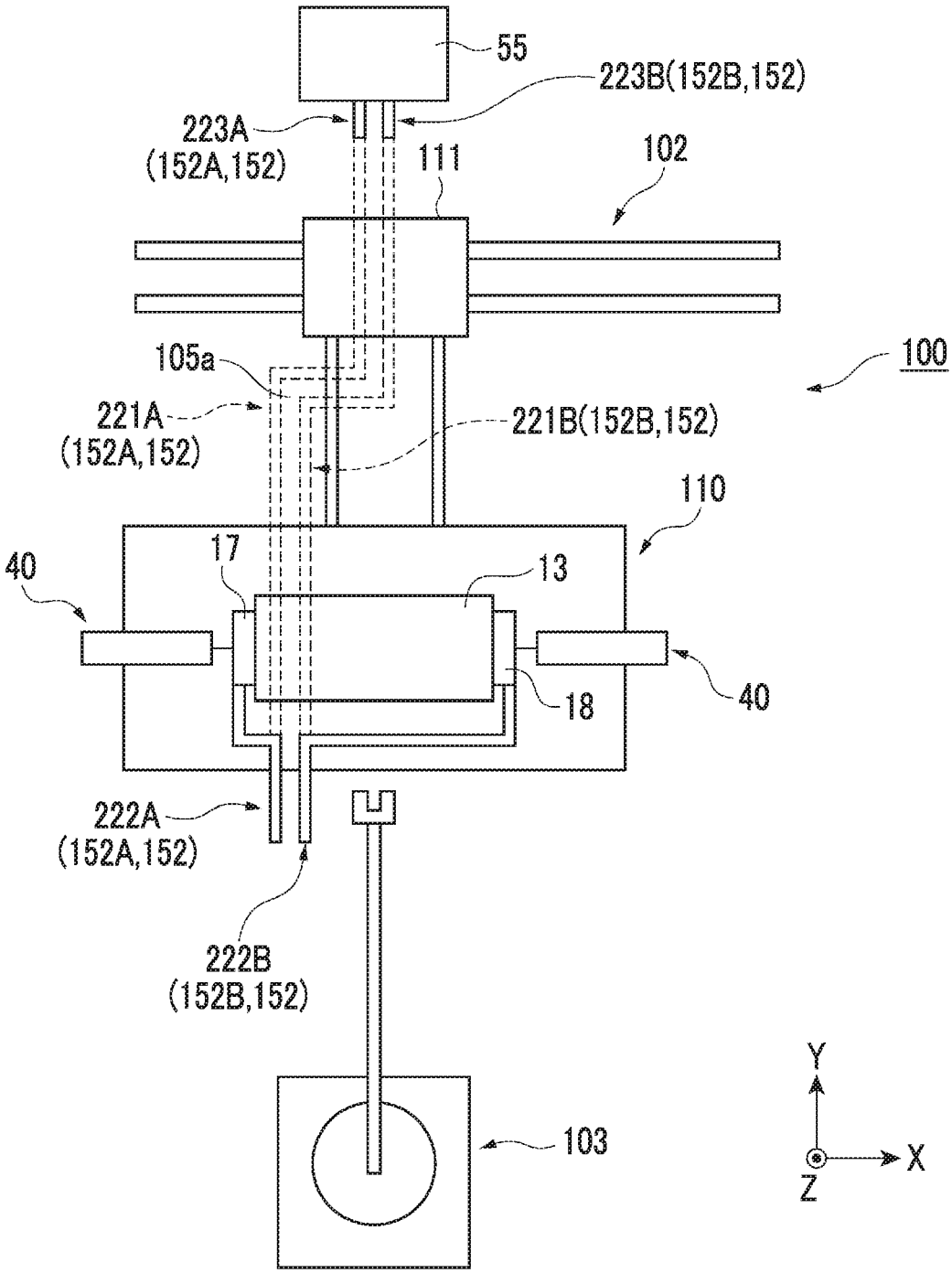
FIG. 6 is a schematic plan view of a forming system according to a modification example.
Figure 7:
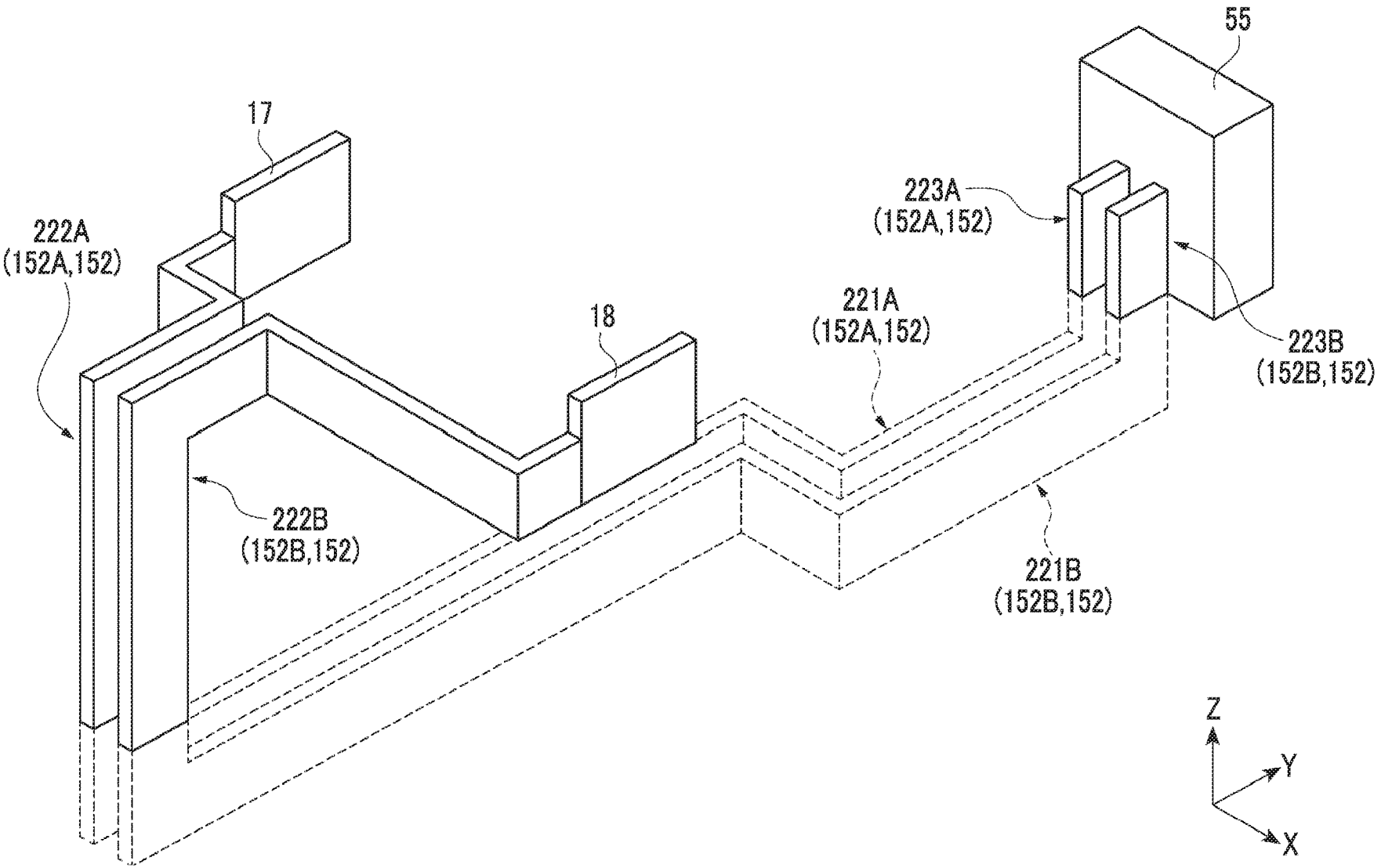
FIG. 7 is a perspective view showing a power supply line of the forming system according to the modification example.

For example, a power supply line 152 as shown in FIGS. 6 and 7 may be adopted. A positive electrode line 152A and a negative electrode line 152B of the power supply line 152 shown in FIGS. 6 and 7 are mainly different from the positive electrode line 52A and the negative electrode line 52B of the power supply line 52 shown in FIGS. 4 and 5 in that the direction in which lower-side passing portions 221A and 221B extend is different from that in the power supply line 52. The power supply unit 55 is disposed at a position separated from the main body part 110 to the positive side in the Y-axis direction. Therefore, the lower-side passing portions 221A and 221B of the positive electrode line 152A and the negative electrode line 152B extend in the Y-axis direction from the power supply unit 55 toward the main body part 110. Further, the lower-side passing portions 221A and 221B pass through the lower side of the main body part 110 and extend to a position on the negative side in the Y-axis direction of the main body part 110. In this way, first connection portions 222A and 222B are drawn to the upper side of the placing surface 105*a* from an area on the negative side with respect to the main body part 110 in the Y-axis direction. The first connection portions 222A and 222B have configurations having the same gist as those of the first connection portions 122A and 122B shown in FIGS. 4 and 5. Second connection portions 223A and 223B have configurations having the same gist as those of the second connection portions 123A and 123B shown in FIGS. 4 and 5.

Figure 8:
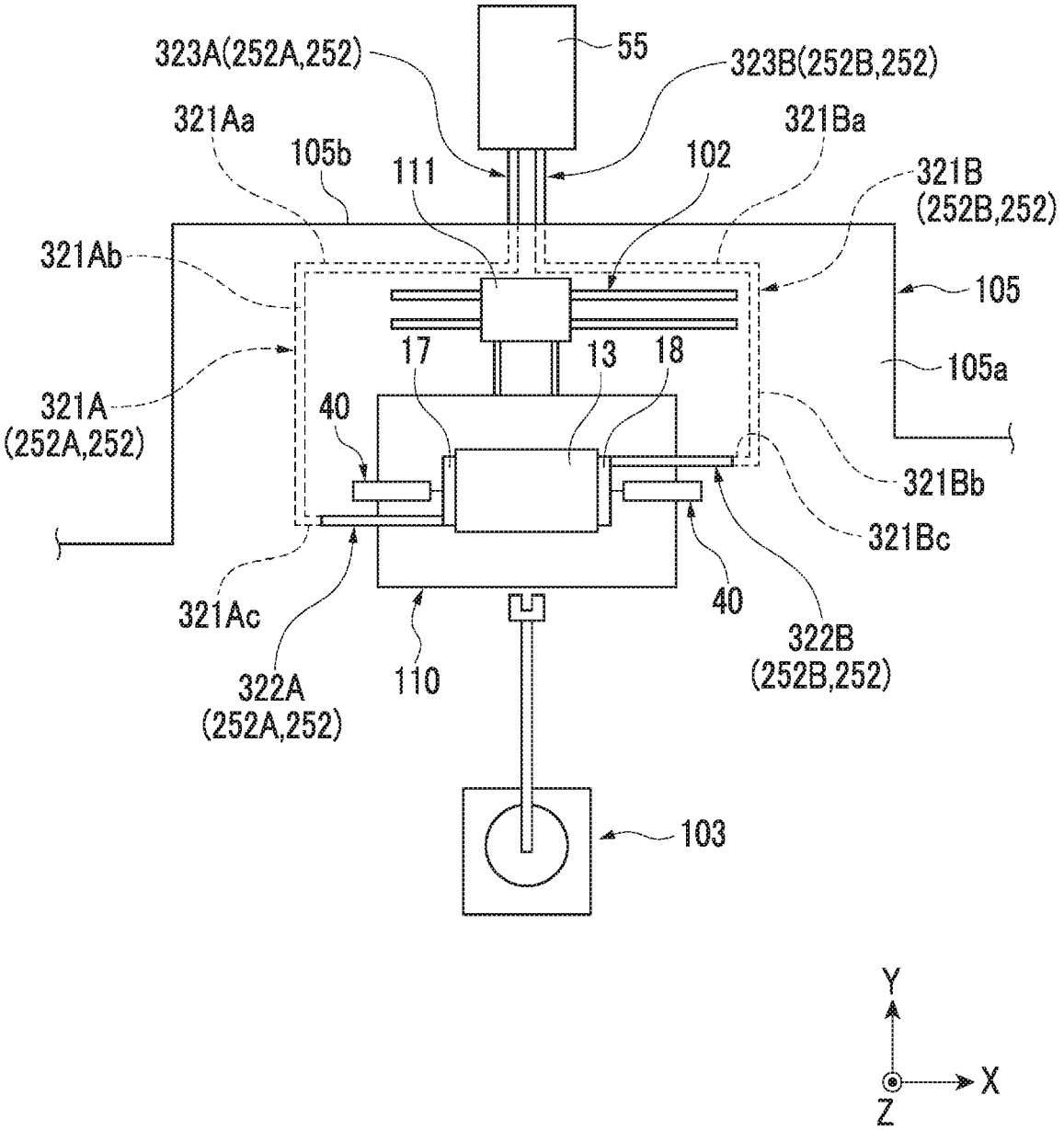
FIG. 8 is a schematic plan view of a forming system according to a modification example.

Further, for example, a power supply line 252 as shown in FIGS. 8 and 9 may be adopted. A positive electrode line 252A and a negative electrode line 252B of the power supply line 252 shown in FIGS. 8 and 9 are mainly different from the positive electrode line 52A and the negative electrode line 52B of the power supply line 52 shown in FIGS. 4 and 5 in that the configurations of lower-side passing portions 321A and 321B, drawing structure of first connection portions 322A and 322B, and drawing structure of second connection portions 323A and 323B are different from those in the power supply line 52.

The power supply unit 55 is disposed at a position separated from the main body part 110 to the positive side in the Y-axis direction. Further, the power supply unit 55 is not provided on the placing surface 105*a* of the placing table 105 and is disposed at a position separated from an end portion 105*b* on the positive side in the Y-axis direction of the placing table 105. Therefore, the second connection portions 323A and 323B are not drawn to the upper side of the placing surface 105*a* and are drawn straight from the lower-side passing portions 321A and 321B through the end portion 105*b*. In this manner, the second connection portions 323A and 323B may not be drawn to the upper side of the placing surface 105*a*. In a case where the power supply unit 55 is close to the end portion 105*b* of the placing table 105, the second connection portions 323A and 323B are also disposed below the placing surface 105*a*. In this case, the second connection portions 323A and 323B may be regarded as simultaneously configuring the lower-side passing portions. Further, the first connection portion 322A is drawn to the upper side of the placing surface 105*a* from an area on the negative side in the X-axis direction with respect to the main body part 110 and is connected to the electrode 17. The first connection portion 322A includes a rising portion 322Aa extending upward, and a connection portion 322Ab which extends from the rising portion 322Aa to the electrode 17 side and is connected to the electrode 17. The first connection portion 322B is drawn to the upper side of the placing surface 105*a* from an area on the positive side in the X-axis direction with respect to the main body part 110 and is connected to the electrode 18. The first connection portion 322B includes a rising portion 322Ba extending upward, and a connection portion 322Bb which extends from the rising portion 322Ba to the electrode 18 side and is connected to the electrode 18.

With such a configuration, the lower-side passing portions 321A and 321B are branched from the second connection portions 323A and 323B, then greatly bypass, and are connected to the first connection portions 322A and 322B, respectively. The lower-side passing portion 321A includes a branch portion 321Aa which extends from the second connection portion 323A to the negative side in the X-axis direction, a bent portion 321Ab which is bent from the branch portion 321Aa and extends to the negative side in the Y-axis direction, and a connection portion 321Ac which extends from the bent portion 321Ab to the positive side in the X-axis direction and is connected to the first connection portion 322A. The lower-side passing portion 321B includes a branch portion 321Ba which extends from the second connection portion 323B to the positive side in the X-axis direction, a bent portion 321Bb which is bent from the branch portion 321Ba and extends to the negative side in the Y-axis direction, and a connection portion 321Bc which extends from the bent portion 321Bb to the negative side in the X-axis direction and is connected to the first connection portion 322B.

In the power supply line 252 shown in FIGS. 8 and 9, the first connection portions 322A and 322B are drawn to the upper side of the placing surface 105*a* from areas on both sides with respect to the main body part 110 in the X-axis direction. In this way, it is possible to prevent the first connection portions 322A and 322B from interfering with the die replacement carriage 111, the forming die 13, or the like at the time of die replacement. Further, since it is possible to secure spaces at side portions on both the positive and negative sides of the main body part 110 in the Y-axis direction, it is possible to dispose peripheral equipment (temperature measuring equipment for measuring the temperature of the die, cooling equipment for cooling the die, or the like) in the spaces.

It should be understood that the invention is not limited to the above-described embodiment, but may be modified into various forms on the basis of the spirit of the invention. Additionally, the modifications are included in the scope of the invention.

What is claimed is:

1. A forming system which forms a metal pipe by expanding a metal pipe material, comprising:

a main body having a forming die for forming the metal pipe;

an electrode which is disposed outside the forming die and causes an electric current to flow through the metal pipe material disposed in the forming die such that the metal pipe material is heated;

a power supply unit which is disposed at a position separated from the main body and supplies electric power to the electrode; and a power supply line which connects the power supply unit and the electrode, wherein the power supply line includes a lower-side passing path which passes through a lower side of a placing surface on which the main body is placed and on which or beside which the power supply unit is placed, a first connection portion which is drawn to an upper side of the placing surface and connects the lower-side passing path and the electrode, and a second connection portion which connects the lower-side passing path and the power supply unit, wherein a pair of the electrode is provided to face each other in a first direction in a horizontal direction so as to support both end sides of the metal pipe material, in a state of being disposed in the forming die, in a longitudinal direction, a die replacement carriage disposition part for allowing a die replacement carriage to advance and retreat is provided on one side with respect to the main body in a second direction orthogonal to the first direction in the horizontal direction, a handling unit which performs installation and removal of the metal pipe material with respect to the forming die is provided on another side with respect to the main body in the second direction, and the first connection portion is drawn to the upper side of the placing surface from a position other than an area on the one side with respect to the main body in the second direction.

2. The forming system according to claim 1, wherein the first connection portion is drawn to the upper side of the placing surface from an area on the other side with respect to the main body in the second direction.

3. The forming system according to claim 1, wherein the first connection portion is drawn to the upper side of the placing surface from each of areas on both sides of the main body in the first direction.

* * * * *